United States Patent [19]

Schindler

[11] 3,959,860

[45] June 1, 1976

[54] METHOD OF MAKING NON-SHORTING PHOTOFLASH LAMP

[75] Inventor: Donald R. Schindler, Burton, Ohio

[73] Assignee: General Electric Company, Schenectady, N.Y.

[22] Filed: Dec. 20, 1974

[21] Appl. No.: 534,819

[52] U.S. Cl. ..... 29/25.16

[51] Int. Cl.[2] ..... H01J 9/18

[58] Field of Search..... 29/25.13, 25.15, 25.16; 65/59 R, 138, 139; 174/111, 50.61, 50.57, 152 GM; 431/95

[56] References Cited

UNITED STATES PATENTS

| | | | |
|---|---|---|---|
| 2,220,741 | 11/1940 | Thorson | 29/25.13 |
| 2,316,999 | 4/1943 | Spencer | 174/50.61 |
| 2,794,699 | 6/1957 | Eber | 316/19 |
| 3,501,254 | 3/1970 | Nijland et al. | 431/95 |
| 3,823,994 | 7/1974 | DeGraaf | 431/95 X |

*Primary Examiner*—Roy Lake
*Assistant Examiner*—James W. Davie
*Attorney, Agent, or Firm*—Norman C. Fulmer; Lawrence R. Kempton; Frank L. Neuhauser

[57] ABSTRACT

A method of making beaded lead-in wires for a photoflash lamp comprising the steps of forming and sealing a glass bead around a pair of lead-in wires, positioning a surface of the bead against a die having openings through which the wires extend, and moving the wires a distance through the openings of the die while the bead is hot, said openings having larger diameters than the wires so that said moving of the wires causes glass sheaths to be formed around the wires adjacent to the bead. The technique can be used to sheath one or both wires, above and/or below the bead. A pair of lead-in wires sheathed below the bead is sealed through the base of a lamp bulb, the lower ends of the sheaths being adjacent to the base seal.

13 Claims, 7 Drawing Figures

METHOD OF MAKING NON-SHORTING PHOTOFLASH LAMP

BACKGROUND OF THE INVENTION

The invention is in the field of photoflash lamps of the type having a pair of lead-in wires carrying a filament or other electrical ignition means inside a bulb containing combustible material such as shredded metal foil and a combustion-supporting gas such as oxygen.

Flash lamps are conventionally constructed with a pair of lead-in wires extending through a seal region at the bottom of the bulb. Cameras and other apparatus for using flash lamps are arranged to normally position the lamps basedown when they are flashed, so that the hot burning metal particles will fall down onto the relatively thick seal region of the bulb and will be less likely to cause cracking of the bulb and explosion of the lamp than if they were to fall against the relatively thin sides or top of the bulb. Occasionally incompletely burned particles of metal (from either or both of the shredded foil and the lead-in wires) fall to the bottom of the bulb and cause shorts, or partial shorts, across the lead-in wires. This is undesirable, especially if more than one lamp is connected in parallel across the source of energy, because the shorted or partially shorted lamp draws and wastes electrical energy from the battery or other source of firing voltage. Also, certain electrical circuits which sequentially flash the lamps of a flash array, such as the FlashBar array now commercially available, require that the lamps have an open circuit, or at least a relatively high impedance compared to that of an unflashed lamp, internally across their lead-in wires after being flashed in order that the circuit can function to flash the next lamp in the array. Also, the flashability of certain types of lamps, such as those designed to be flashed by a high voltage, low current power source, may be impaired or prevented if the lead-in wires are shorted together by one or more strands of the combustible metal foil.

U.S. Pat. No. 3,816,054 to Baldrige and Sobieski discloses a flash lamp construction having a glass sleeve around one of the lead-in wires for reducing the likelihood of after-flash shorting. Another known technique is to enclose the lead-in wires with glass extending from the bottom of the bulb. U.S. Pat. No. 3,501,254 is an example of such a technique.

SUMMARY OF THE INVENTION

Objects of the invention are to provide improved photoflash lamps, to provide photoflash lamps which will almost invariably have an open circuit or high impedance after flashing, and to provide photoflash lamps in which shorting across the lead-in wires by strands of the combustible metal foil before flashing, which would impair flashability, is substantially prevented.

The invention comprises, briefly and in a preferred embodiment, a method of sheathing an elongated conductor member adjacent to a vitreous member (such as glass) to which the conductor member is sealed, comprising the steps of positioning the conductor member through an opening in a die, with the vitreous member against the die, and moving the conductor member farther through the die opening while the vitreous member is hot and plastic, said opening in the die having a diameter greater than that of the conductor member so that said moving of the conductor member causes a sheath of the vitreous material to be formed around the conductor member. In specific embodiments, the technique is used to sheath one or both lead-in wires for a photoflash lamp adjacent to a glass bead through which the wires are sealed. Such sheaths can be made above and/or below the bead. In a preferred embodiment, each of a pair of lead-in wires is sheathed below the bead, and the wires are sealed through the base of a lamp bulb, the lower ends of the sheaths being near, against, or embedded within a lead-in seal at the base of the lamp. This prevents strands of metal foil or partially unburned metal particles in a flashed lamp from short-circuiting across the lead-in wires at the bottom of the lamp bulb. A further sheath around one or both of the lead-in wires above the bead reduces the likelihood of shorting caused by metal accumulating on top of the bead.

DESCRIPTION OF THE PREFERRED EMBODIMENTS

Figure 1:
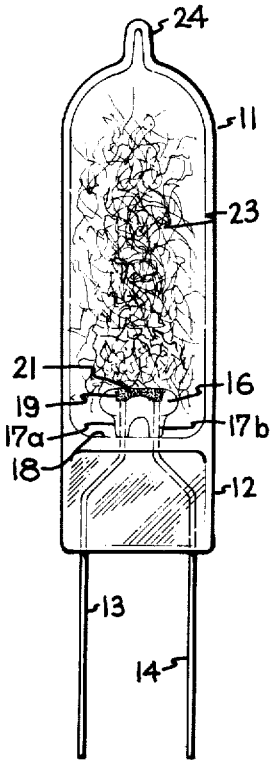
FIG. 1 is a side view of a photoflash lamp made in accordance with the method of the invention.
Figure 5:
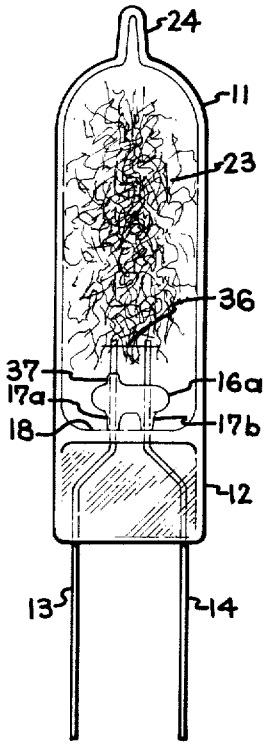
FIG. 5 is a side view of a photoflash lamp similar to that of FIG. 1, but employing a filament type of flash initiation means.

The lamp shown in FIG. 1 of the drawing is generally the same, except for its bead and flash initiation arrangement, as that shown in FIG. 5 of U.S. Pat. No. 3,506,385 to Kurt Weber and George Cressman, and comprises a tubular envelope 11, preferably made of a borosilicate glass or other suitable vitreous material having a stem press seal 12 at one end thereof through which a pair of lead-in wires 13, 14 extend from the exterior to the interior of the bulb 11 in a mutually parallel spaced-apart manner. A bead 16 of glass or other suitable vitreous material, and made in accordance with the method of the invention, is sealed around both lead-in wires within the bulb 11, and is provided with downwardly extending sheaths **17*a* and 17*b* around the lead-in wires, respectively, and terminating adjacent to the bottom 18 of the bulb 11 at the top of the seal 12, i.e., extending near to, or abutting against, or embedded within the bottom surface 18 of the interior of the bulb 11**.

The top of the bead 16 is provided with a recess 19 which carries a primer material 21 therein, the primer material 21 being in engagement with and extending across the upper ends of the lead-in wires 13 and 14 within the bulb 11. Various suitable primer materials are known; for example, a mixture may be prepared of fine particles of zirconium and potassium perchlorate along with a binder such as nitrocellulose and a solvent such as amyl acetate. This mixture, in liquid form, is applied to the opening 19, for example with a syringe or by daubing. The binder and solvent are then dried out from the primer material 21.

The flash lamp is completed by substantially filling the bulb 11 with a loose mass of filamentary or shredded metal foil or wire 23 of zirconium or hafnium or other suitable combustible metal. Air is exhausted from the bulb 11, and the bulb is filled with oxygen at a pressure of at least several atmospheres, such as about 5 to 10 atmospheres, and is sealed off at an exhaust tip 24 at the other end thereof from the stem press seal 12. The lamp may be coated with the usual lacquer or plastic protective coating. The lamp shown in FIG. 1 is a so-called high voltage type, requiring a firing voltage of up to hundreds of volts, or perhaps a few thousand volts, which may be of low energy, applied across the lead-in wires 13 and 14, which ignites the primer 21 which, in turn, ignites the combustible metal 23 which burns rapidly, with the aid of the oxygen in the lamp, producing a bright flash of light. In this type of lamp, it is essential to prevent shorting the lead-in wires together, as by a strand of shredded metal foil, so that the electrical energy is diverted and does not actuate the primer.

Figure 2:
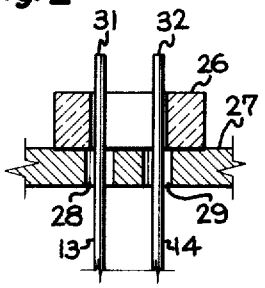
FIG. 2 is a side sectional view of a glass ring positioned around a pair of lead-in wires and resting on a forming die.
Figure 3:
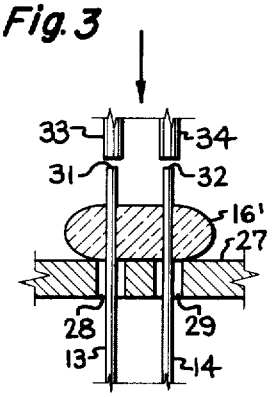
FIG. 3 is a side sectional view the same as FIG. 2, except that the glass ring has been heated to form a bead sealed around the wires, and a pair of plungers are ready to force the wires downwardly a distance through openings in the die.
Figure 4:
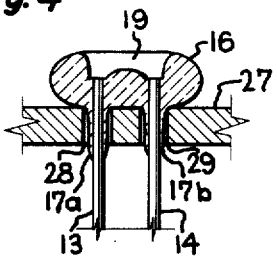
FIG. 4 is the same as FIG. 3, except that the wires have been moved a distance downwardly through the openings in the die, carrying with them some of the softened heated glass thereby forming sleeves extending downwardly from the bead.

In accordance with the invention, the bead 16 and the integral sheaths 17*a* and 17*b* are made by the following method. First the bead 16 is formed and sealed around the lead-in wires 13 and 14 at approximately the desired location, for example, as shown in FIG. 2 in which a ring 26 of glass or other suitable material is placed around the pair of mutually parallel spaced-apart lead-in wires 13 and 14, and rests on the top surface of a forming die 27 having a pair of openings 28, 29 through which the lead-in wires 13 and 14 extend, the upper ends 31 and 32 of the lead-in wires protruding slightly above the top surface of the glass ring 26. The glass ring 26 is then heated to cause it to melt or flow so as to form a bead 16′ sealed around the two lead-in wires, as shown in FIG. 3. While the bead 16′ is hot enough to be deformable, the wires 13 and 14 are moved downwardly a distance through the openings 28 and 29, such as being pushed by plungers or push rods 33 and 34 against their upper ends 31 and 32. The openings 28 and 29 in the die 27 are sufficiently large as compared with the diameter of the lead-in wires 13 and 14, so that as the lead wires 13 and 14 are moved downwardly, the wires pull down and draw with them some of the material of the bead 16, thereby forming the sheaths 17*a* and 17*b* around the lead-in wires 13 and 14 and within or through the openings 28 and 29 of the die 27. The push rods 33 and 34 may be moved downwardly sufficiently to enter into and partly through the body of the bead 16, thereby forming the hollow cavity 19 into which the primer material 21 will subsequently be placed. The push rods may also be instrumental in pressing and molding the bead material into the openings 28 and 29, and may help to prevent the glass from closing over the top of one or both lead-in wires 13 and 14. The push rods 33 and 34 can be replaced by a single member of suitable shape for accomplishing the intended purpose. Alternatively, the lead-in wires 13 and 14 may be pulled downwardly by suitable means, and if pulled downward a sufficient amount, the primer cavity 19 will tend to be formed, and the formation thereof may be further aided by means of an additional die or tool temporarily placed therewithin. Upon sufficient cooling of the bead 16 and sheaths 17*a* and 17*b*, the bead and lead wire assembly (called a mount) are removed from the die 27, the lead wires 13 and 14 are bent to the shape shown in FIG. 1, and are sealed within the base 12 of the bulb 11 as has been described.

Figure 6:
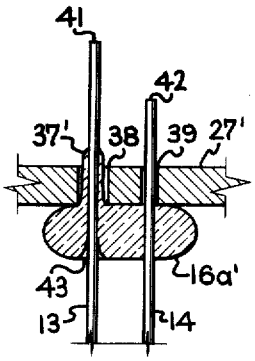
FIG. 6 illustrates the step of die-forming a sleeve around one of the lead-in wires above the bead.
Figure 7:
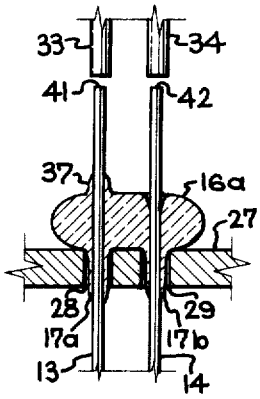
FIG. 7 shows the step of die-forming sleeves around both lead-in wires below the bead, while retaining a sheath around the one wire above the bead.

The embodiment of FIGS. 5, 6 and 7 is similar to that of FIGS. 1–4, except that instead of being a so-called high voltage type of lamp having a primer 21 connected directly across the lead-in wires within the lamp, the lamp is a so-called low voltage type having a filament 36 connected across the lead-in wires within the bulb 11. For this purpose, the lead-in wires 13 and 14 extend a distance upwardly from the top of the bead 16*a*. The filament 36 and/or the upper ends of the lead-in wires 13 and 14 within the bulb 11 are coated by primer material in well-known manner to facilitate ignition of the filamentary metal material 23 when current is applied through the filament 36. The embodiment of FIGS. 5, 6 and 7 also differs from that of FIGS. 1–4 in that one or both of the lead-in wires 13, 14 is provided with a sheath 37 integral with and extending above the bead 16*a*.

The bead 16*a*, with integral sheaths around lead-in wires both above and below the bead body, is made by the following method. The lead wires 13 and 14 are positioned through openings 38 and 39, respectively, in a die 27′, the opening 38 being substantially larger in diameter than that of the lead-in wire 13, and opening 39 being only slightly larger in diameter than that of the lead-in wire 14. In the intermediate step shown in FIG. 6, the bead body 16*a′* has been formed and sealed around the lead-in wires 13 and 14, and, with the bead body 16*a′* heated to a suitable temperature, and also the die 27′ being heated if necessary, the lead-in wire 13 has been moved upwardly a distance so as to draw and form a sheath 37′ around the lead-in wire 13 above the bead body 16*a′*. Upon completing this step, the sheath 37′ will extend a greater distance upwardly from the bead 16*a′* than will the sheath 37 in the final assembly. After the step shown in FIG. 6, the top end of the lead-in wire 13 will be higher than that of the lead-in wire 14, for a reason to be described. In performing the aforesaid step of the method, the lead-in wire 14 need not be moved, or may be moved upwardly if desired, simultaneously with the upward movement of the wire 13, but the opening 39 in the die around the wire 14 is so small that little or no sheath will be formed around the wire 14. In performing the step of FIG. 6, it may be desirable to turn the arrangement upside down, so that the sheath 37′ will be drawn downwardly through the die 27′, and so that the die 27′ will support the bead body 16*a′*. It will be noted that in performing the step of FIG. 6 a small dimple or void 43 has been formed at the underside of the bead body 16*a′* around the lead-in wire 13.

When the beaded lead-in wire assembly of FIG. 6 has cooled sufficiently, it is slid out of the die 27′, and the lead-in wires 13 and 14 are inserted through openings 28 and 29 in the die 27, as shown in FIG. 3, whereupon the lead-in wires 13 and 14 are moved downwardly, such as being pushed down by push rods 33 and 34, thus forming the downwardly extending sheaths 17*a* and 17*b* around the lead-in wires 13 and 14, respectively, as shown in FIG. 7. By having provided for the upper end 41 of the lead-in wire 13 to extend higher than the upper end 42 of lead-in wire 14, as shown in FIG. 6, in performing the step of FIG. 7, the dimple 43 of FIG. 6 is filled in prior to the sheath 17*a* being formed, so that upon completion of the step shown in FIG. 7, the sheaths 17*a* and 17*b* will extend approximately equal distances downwardly from the bead 16*a*. Also, in performing the step shown in FIG. 7, the upperwardly extending sheath 37' shown in FIG. 6 around the wire 13 will become shortened such as to approximately the shape shown in FIGS. 5 and 7. Upon suitably cooling the bead and lead-in wire assembly after performing the step shown in FIG. 7, it is removed from the die 27, and the lead-in wires 13, 14 are bent to the shape shown in the region of the seal 12, and the lead wires are then sealed into the bulb at 12, with the lower ends of the sheaths 17*a* and 17*b* being adjacent to the bottom 18 of the inside of the bulb 11. By this terminology, it is meant that the bottom edges of the sheaths 17*a* and 17*b* are near to, abut against, or are embedded into, the bottom surface 18 of the bulb 11. In carrying out the step of FIG. 6, the die 27 of FIG. 7 can be positioned against the underside of the bead body 16*a'*, and the lead-in wires can be moved up and down in quick succession to form the sheaths 37, 17*a*, and 17*b*.

In carrying out the invention, the die 27 may or may not need to be heated by flames or otherwise in order to cause the sheaths 17*a*, 17*b*, and 37' to form properly depending on various factors such as the relative diameters of the die openings 28, 29, and 38 with respect to the diameters of the lead-in wires 13 and 14. If the dies 27 and 27' require heating, they can be heated by the same flames that are used for heating the glass ring 26 and forming and sealing the bead body 16' or 16*a'* around the lead-in wires 13 and 14.

As has been explained, the downwardly extending sheaths 17*a* and 17*b* prevent metal debris, such as unburned foil, or otherwise, in a flashed lamp from settling on the bottom 18 of the bulb 11 so as to cause a short or partial short between the lead-in wires 13 and 14. The upwardly extending sheath 37 around at least one of the lead-in wires 13 in the embodiment of FIG. 5 helps prevent metal debris from a flashed lamp from causing a short or partial short between the lead-in wires 13 and 14 at the top of the bead 16*a*. If the lead-in wires 13 and 14 are the type which melt and burn back toward the bead 16*a* when the lamp is flashed, providing the sheath 37 around only one of the lead-in wires as shown will increase the distance between the burned-back upper ends of the lead-in wires within the bulb and thus further reduce the likelihood of the lamp becoming shorted or partly shorted after flashing, as is more fully described in the above-referenced patent to Baldrige and Sobieski.

It will be understood that, in accordance with well-known glassworking technology, the steps referred to above may be compounded as necessary for heating, forming, and cooling, so as to obtain the desired configuration.

While preferred embodiments of the invention have been shown and described, various other embodiments and modifications thereof will become apparent to persons skilled in the art and will fall within the scope of the invention as defined in the following claims.

What I claim as new and desire to secure by Letters Patents of the United States is:

1. A method of beading and sheathing an elongated electrical conductor comprising the steps of sealing a bead of vitreous material around said conductor, providing a die having an opening therein, positioning said conductor into said opening so that said bead rests against a surface of the die, moving said conductor axially in said opening in a direction away from said bead, said opening being sufficiently greater in diameter than said conductor and said bead being sufficiently hot during said moving of the conductor so that material of said bead is drawn only by said conductor into said opening thereby forming a sheath extending from a side of said bead and around a length of said conductor, and removing said beaded and sheathed conductor from said die.

2. A method as claimed in claim 1, including the additional steps of positioning the part of said conductor extending from the other side of the bead from said sheath into an opening of a die with said other side of the bead resting on a surface thereof, moving said conductor axially in the last-named opening in a direction away from said bead, said last-named opening being sufficiently greater in diameter than said conductor and said bead being sufficiently hot so that material of said bead is drawn only by said conductor into said last-named opening thereby forming a second sheath extending from the other side of said bead and around a length of said conductor, and removing said beaded and sheathed conductor from said last-named die.

3. A method of making an electrical flash lamp mount comprising the steps of positioning a pair of elongated electrical lead-in conductors substantially parallel to and spaced apart from each other, sealing a bead of vitreous material around said pair of lead-in conductors, providing a die having a pair of openings therein spaced apart substantially the same distance as said pair of lead-in conductors, positioning said conductors respectively into said openings so that said bead rests against a surface of the die, moving at least one of said conductors axially in its respective opening in a direction away from said bead, said respecttive opening being sufficiently greater in diameter than said moving conductor and said bead being sufficiently hot during said moving of the conductor so that material of said bead is drawn only by said conductor into said respective opening thereby forming a sheath extending from a side of said bead and around a length of the moved conductor, and removing said beaded and sheathed conductors from said die.

4. A method as claimed in claim 3, including the additional step of sealing said mount to a bulb with said conductors sealed through a seal region of the bulb and with said bead inside the bulb, said sheath extending from said bead toward said seal region with the end thereof adjacent to said seal region.

5. A method as claimed in claim 3, in which both of said conductors are moved axially in their respective openings in a direction away from said bead, both of said openings in the die being sufficiently greater than said conductors so that material of said bead is drawn into both said openings of the die thereby forming individual sheaths extending from said bead around a length of each of said conductors.

6. A method as claimed in claim 5, including the additional step of sealing said mount to a bulb with said conductors sealed through a seal region of the bulb with said bead inside the bulb, said sheaths extending from said bead toward said seal region with the ends thereof adjacent to said seal region.

7. A method as claimed in claim 5, in which said step of moving both conductors axially in the openings of the die comprises positioning pushing means against the ends of the conductors over the side of the bead away from said die, and moving said pushing means into said bead thereby forming said sheaths and also forming a cavity in said bead extending across said ends of the conductors and suitable for containing primer material for igniting a flash lamp.

8. A method as claimed in claim 3, including the additional steps of positioning the portions of said conductors extending from the other side of the bead from said sheath into openings of a die with said other side of the bead resting on a surface thereof, moving at least one of said conductors axially in its respective opening in a direction away from said bead, the last-named respective opening being sufficiently greater in diameter than the moving conductor so that material of said bead is drawn only by said conductor into said last-named respective opening thereby forming a second sheath extending from the other side of said bead and around a length of the last-named conductor, and removing said beaded and sheathed conductors from said last-named die.

9. A method as claimed in claim 8, including the additional step of sealing said mount to a bulb with said conductors sealed in a seal region of the bulb and said bead inside the bulb with one of said sheaths extending from said bead toward said seal region with the end thereof adjacent to said seal region.

10. A method as claimed in claim 3, in which a sheath is formed around only one of said conductors, and including the additional steps of positioning the portions of said conductors extending from said opposite side of the bead into openings of a die with said opposite side of the bead resting on a surface thereof, moving at least one of said conductors axially in its respective opening in a direction away from said bead, the last-named respective opening being sufficiently greater in diameter than the moved conductor so that material of said bead is drawn only by said conductor into said last-named respective opening thereby forming an additional sheath extending from said opposite side of the bead and being around a length of said moved conductor, whereas the first-named sheath remains and is reduced in length and removing said beaded and sheathed conductors from said last-named die.

11. A method as claimed in claim 10, including the additional step of sesaling said mount to a bulb with said conductors sealed through a seal region of the bulb and with said bead inside the bulb, said additional sheath extending from said bead toward said seal region with the end thereof adjacent to said seal region.

12. A method as claimed in caim 3, in which a sheath is formed around only one of said conductors, said one of the conductors extending farther than the other conductor from said side of the bead after forming said sheath, and the forming of said sheath causing a dimple to form in the bead around said one conductor at the opposite side of the bead from said sheath, and including the additional steps of positioning the portions of said conductors extending from said opposite side of the bead into openings of a die with said opposite side of the bead resting on a surface thereof, moving both of said conductors axially in their respective openings in a direction away from said bead, the last-named respective openings being sufficiently greater in diameter than the conductors so that material of said bead is drawn only by said conductors into said last-names respective openings thereby forming additional sheaths extending from said opposite side of the bead and being individually around lengths of said conductors, said one of the conductors being moved farther than the other in said step of moving both conductors so as to compensate for said dimple and cause said additional sheaths to extend approximately equal lengths along said conductors, whereas the first-named sheath remains and is reduced in length, and removing said beaded and sheathed conductors from said last-named die.

13. A method as claimed in claim 12, including the additional step of sealing said mount to a bulb with said conductors sealed through a seal region of the bulb and with said bead inside the bulb, said additional sheaths extending from said bead toward said seal region with the ends thereof adjacent to said seal region.

* * * * *